US005765622A

United States Patent [19]

Lichy

[11] Patent Number: 5,765,622

[45] Date of Patent: Jun. 16, 1998

[54] VERTICALLY MOVEABLE FLEXIBLE DOOR WITH RELEASABLE BOTTOM BAR

[75] Inventor: Dale M. Lichy, Gibsonia, Pa.

[73] Assignee: Thruways Doorsystems Inc., Pittsburgh, Pa.

[21] Appl. No.: 745,832

[22] Filed: Nov. 8, 1996

[51] Int. Cl.[6] ..... E06B 9/17

[52] U.S. Cl. ..... 160/273.1; 160/201

[58] Field of Search ..... 160/273.1, 272, 160/271, 270, 201, 205, 265, 133, 200, 199, 206; 16/97, 98, 99, 100, 101, 102, 103, 104, 105, 106, 107

[56] References Cited

U.S. PATENT DOCUMENTS

| | | | |
|---|---|---|---|
| 2,525,309 | 10/1950 | Norberg | 160/209 X |
| 4,478,268 | 10/1984 | Palmer . | |
| 4,601,320 | 7/1986 | Taylor | 160/271 |
| 4,676,293 | 6/1987 | Hanssen | 160/201 |
| 4,924,932 | 5/1990 | Esnault | 160/201 |
| 5,025,847 | 6/1991 | Mueller | 160/265 X |
| 5,056,579 | 10/1991 | Krafutler | 160/271 |
| 5,131,450 | 7/1992 | Lichy . | |
| 5,139,074 | 8/1992 | Warner | 160/265 X |
| 5,163,495 | 11/1992 | Lichy . | |
| 5,271,448 | 12/1993 | Delgado | 160/265 |
| 5,351,742 | 10/1994 | Lichy . | |
| 5,445,209 | 8/1995 | Lichy . | |
| 5,482,104 | 1/1996 | Lichy . | |
| 5,535,805 | 7/1996 | Kellogg et al. | 160/201 |

OTHER PUBLICATIONS

The Low Maintenance Environmental Doors Series 620 and Series 520 EnviroDor Inc., Pittsburgh, Pennsylvania (Brochure).

*Primary Examiner*—David M. Purol

*Attorney, Agent, or Firm*—Jacobson, Price, Holman & Stern, PLLC

[57] ABSTRACT

A damage minimizing closure door moveable vertically between open and closed positions wherein the closure door is a continuous flexible curtain having a rigid bottom bar that is releasably connected to guide structures adjacent a door opening. The side edges of the curtain may separate from the guide structures upon being impacted by an externally applied force. During relatively high wind pressure or differential pressure conditions across the door, causing the flexible curtain to tend to billow or move transversely in directions into and away from the door opening, frictional contact develops between the faces of the curtain and the guide structures as well as between a wind bar and windstrip associated with the door and guide structures. The rigidity of the bottom bar tied into the guide channel structures reduces this effect of friction, thus easing the upward and downward movement of the door within the guide structures.

29 Claims, 3 Drawing Sheets

VERTICALLY MOVEABLE FLEXIBLE DOOR WITH RELEASABLE BOTTOM BAR

CROSS-REFERENCE TO RELATED PATENTS

This application is related to U.S. Pat. Nos. 5,445,209 and 5,482,104, each entitled Guide System For Vertically Moveable Flexible Door, issued on Aug. 29, 1995, and Jan. 9, 1996, respectively, to the same inventor as the present application and assigned to the same assignee, each of which are incorporated by reference herein.

This application is also related to U.S. Pat. Nos. 5,131,450, 5,163,495, and 5,351,742 also to the same inventor and assigned to the same assignee as the present application.

BACKGROUND OF THE INVENTION

1. Field of the Invention

The present invention generally relates to a damage minimizing closure door that is moveable vertically between open and closed positions, wherein the closure door is a continuous, flexible curtain. A guide structure or assembly is mounted adjacent the sides of a door opening for receiving and guiding the side edges of the flexible curtain during vertical movement. The side edges of the curtain may separate from the guide assembly upon being impacted by an externally applied force, such as by a vehicle, without damaging the curtain or guide assembly and also enabling the side edges of the curtain to be easily reinserted into the guide assembly. The flexible curtain includes a rigid bottom bar that is releasably connected with the guide assembly, preferably through a roller that rides within a roller guideway of the guide assembly, so that the lateral or transverse structural strength of the bottom bar extends into the roller guideway while also enabling the rigid bottom bar, and curtain, to break away if impacted by external forces.

2. Description of Related Art

Vertically disposed doors which move between open and closed positions are well-known. Such doors or curtains are constructed of flexible material with guides along the side edges of the door opening to receive, retain, and guide the side edges of the curtain. Commonly-owned U.S. Pat. Nos. 5,445,209 and 5,482,104 disclose vertically movable closure doors comprising a flexible curtain which is moveable vertically between a closed position to close off a door opening and an open position. The curtain includes side edges having windstrips along portions of the side edges. Mounted adjacent each side of the door opening, via a mounting bracket, are the curtain guides, each of which include a releasable windbar that co-acts with the windstrips to restrain the side edges of the curtain from escaping from the curtain guide under normal wind load and differential pressure conditions across the door opening. When an excessive impact force is placed upon the flexible curtain such as the curtain being accidentally struck by a vehicle, a lateral displacement of the curtain causes the windstrips to engage the windbar and to cause the windbar to be displaced by separation from the curtain guide thereby enabling the side edges of the curtain to be released from the curtain guide. This prevents damage to the flexible curtain yet enables the curtain to be easily reinserted back into the curtain guide with the windbar snapped back into the guide. Damage to the curtain and the windbar are thus negligible. Such doors, as are disclosed in the above patents, include a bottom bar that adds some weight and lateral stability to the curtain, but the bottom bar is not tied into, or associated with, the side guide structure mounted adjacent the side of the door opening. Thus the bottom bar does not appreciably reduce the tendency of the curtain to move in transverse directions, i.e. into and away from the plane of the door opening, under relatively high wind loads or differential pressure conditions that may normally arise. Further, because the horizontal dimension of the bottom bar is less than the horizontal dimension of the curtain, a small area between each side end of the bottom bar and the guides remains and is able to flex under excessive wind loads or differential pressure conditions that may normally arise. As a result, the curtain is able to cause excessive resistance against the guide, possibly causing the curtain to hang up in its downward travel while closing.

Under such relatively high, yet normal, windload and differential pressure conditions, there is a tendency for flexible curtain doors as described in the above-mentioned patents to billow or move outward or inward depending upon the differential pressure conditions and thus result in frictional engagement between faces of the curtain adjacent the side edges and the guide which reduces the ease of upward and downward movement of the curtain in the guide. Friction may also result from the engagement between the windbar and windstrips. The bottom bar, since it is not tied into the guide structure, does little to prevent the curtain from moving inwardly and outwardly.

Bottom bars other than those disclosed in the above-mentioned patents also have been utilized by the assignee of the present invention, as is described in a brochure entitled "The Low Maintenance Environmental Doors" depicting the Series 520 and 620 doors where the bottom bar incorporates a spring loaded retainer that bears against the guide during normal upward and downward movement. However, this break-away bottom bar system itself results in friction during upward and downward movement and does not adequately extend the lateral structural strength of the bottom bar into the guide structure to sufficiently reduce transverse movement of the curtain and thus does not solve the problem of reducing friction during upward and downward movement of the door.

U.S. Pat. No. 4,478,268 to Palmer (which was reexamined, resulting in issuance of Reexamination Certificate No. B1 4,478,268) discloses a damage minimizing flexible door with a rigid bottom bar. The rigid bottom bar itself separates from the curtain upon a predetermined impact force. A roller appears to be associated with the flexible curtain but appears to remain connected to the curtain during release of the curtain from a guide.

In applicant's co-pending U.S. patent application Ser. No. 08/671,236, filed on Jun. 27, 1996, entitled "Overhead Door With Releasable Breakaway Panel", an overhead door formed from a plurality of rigid rectangular panels is disclosed, which includes breakaway bottom sub-panels. This door is not a continuous flexible curtain. A releasable roller assembly is connected to the bottom of the releasable panel.

SUMMARY OF THE INVENTION

The present invention relates to a releasable bottom bar assembly for a closure door comprising a continuous flexible curtain that is moveable vertically between open and closed positions. In a preferred embodiment, the flexible curtain includes windstrips on at least portions of the curtain side edges. Adjacent each side of the door is a guide within which the side edges of the curtain are retained. The guides are mounted preferably to the wall adjacent the door opening by a mounting bracket. Detachably connected to the guide is a windbar that coacts with the curtain windstrips. Upon an excessive impact force on the curtain, the windbar releases by separation from the guide when the windstrips coact therewith. This windbar is then re-attachable to the guide. These features of the present invention are substantially identical to corresponding elements described in U.S. Pat. No. 5,445,209, incorporated by reference herein. Although the releasable bottom bar assembly of the present invention is particularly advantageous with a flexible curtain having windstrips that coact with windbars, it is not required that such windstrips and windbars be utilized under all circumstances. The releasable bottom bar will have applicability with flexible curtains that lack such windstrips and windbars, such as small doors or doors utilized in light duty environments.

In the present invention, the mounting bracket and the curtain guide defines a roller guideway to receive a roller that rolls within the guideway during upward and downward movement of the curtain. Once face of the guideway is defined by the curtain guide. The other opposing face of the guideway is defined by a surface of the mounting bracket or a surface of the wall adjacent the door opening. The roller includes a roller shaft that is journalled to the roller to enable the roller to rotate about the shaft. The roller shaft is releasably connected to a retainer that is in turn fixedly connected to a rigid bottom bar attached to the lowermost edge of the curtain. The shaft is releasable from the retainer when a predetermined impact force is provided to the bottom bar, such as when the bottom bar is struck by a vehicle. The retainer includes a retaining clip that releasably captures a cylindrical retaining tube, into which the roller shaft is received. When a predetermined impact force is applied to the bottom bar, the retaining clip and cylindrical retaining tube separate with respect to each other thus enabling the roller to be disengaged from the bottom bar and enabling the rigid bottom bar to move in directions into and away from the doorway opening. The bottom bar releases prior to disengagement of the windbar from the guides. The releasable rigid bottom bar is thus tied into the roller guideway, via the retaining member and roller shaft to provide lateral and transverse structural rigidity to at least the bottom region of the curtain and to thus reduce the tendency of that region of the curtain to move inwardly and outwardly during normal vertical movement of the curtain, thus minimizing friction between the curtain and the guide and minimizing friction between the windbar and windstrips.

The curtain, at its upper end, is secured to a cylindrical roller shaft which is driven either manually or by a motor, as is described in U.S. Pat. No. 5,445,209, incorporated by reference herein, to cause the curtain to move upward and downward. The rigidity of the roller provides additional lateral and transverse stability of the curtain and thus also serves to minimize friction between the curtain and the guide during normal up and down movement.

It is an object of the present invention to provide a vertically movable continuous flexible curtain that moves into and out of registry with a door opening wherein the side edges of the curtain are guided by side-mounted guide structures. It is an object of the invention to provide for increased lateral and transverse structural stability to the curtain, at least at the bottommost region of the curtain, to reduce the effect of friction between the curtain, curtain guide, windbar and windstrip (if utilized) and to enable easier upward and downward movement of the curtain. It is further an object of the present invention to provide a releasable bottom bar that is fixed to the curtain yet is releasable from the guide structures mounted on opposite sides of the door opening so that when the bottom bar is struck by a vehicle, damage to the guide structure and the curtain is significantly minimized.

Thus, it is an object of the present invention to provide a vertically movable flexible curtain-type door having a rigid bottom bar which is tied into the side channels of the curtain to provide weight to the bottom of the curtain and to reduce the effect of friction between the curtain and the guide, and between the windstrip and windbar, during normal vertical movement of the curtain under various wind load and pressure conditions acting on the curtain. It is further an object of the present invention to enable the rigid bottom bar to be releasable from the side-mounted guide structures.

These and other objects of the invention will be apparent when reference is made to the foregoing detailed description and the accompanying drawings.

DESCRIPTION OF THE PREFERRED EMBODIMENTS

Figure 1:
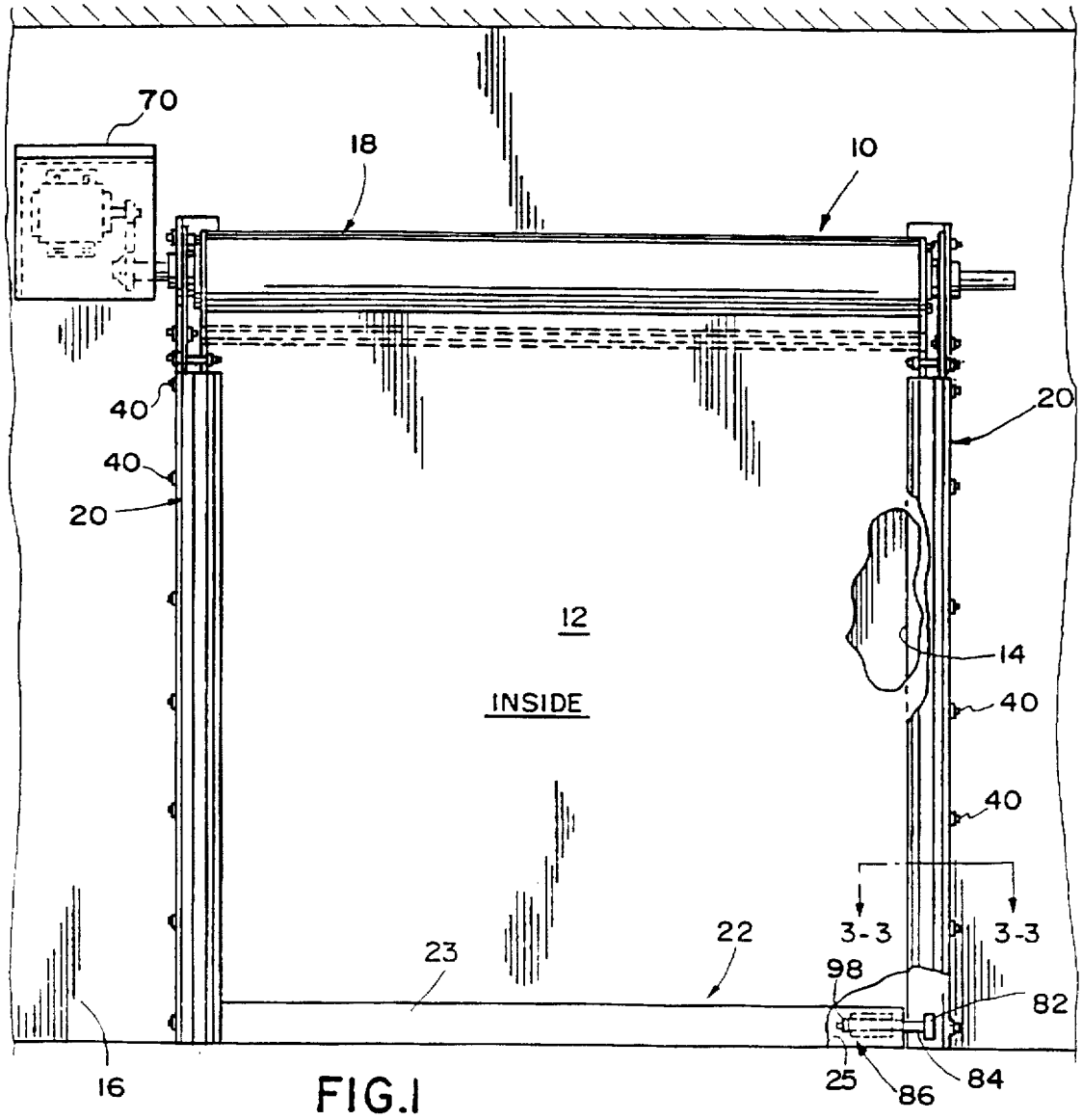
FIG. 1 is an elevational view of a roll up type vertically moveable flexible curtain-type door viewed from the inside with a lowermost corner cutaway.

The preferred embodiment of the present invention represents an improvement over the vertically moveable flexible door arrangements as described in U.S. Pat. Nos. 5,445,209 and 5,482,104 incorporated by reference herein. The improvement resides in the structure of the bottom bar and its interconnection with the side-mounted guide structures in a manner to be described hereinbelow. All of the other components of the vertically moveable flexible door may be the same as is disclosed in the above-mentioned patents, it being understood that the use of windstrips and windbars may not be required in certain environments.

The closure door of the present invention generally designated by reference numeral 10 includes a flexible door or curtain 12 having sufficient length and width characteristics to form a closure for a doorway or opening 14 in a wall 16 of a building structure. The "inside" and "outside" of the doorway is designated in the drawings but it should be appreciated that these are arbitrary designations, particularly when the doorway is an internal doorway within a building. The door 10 includes a roll up drum generally designated by reference numeral 18 oriented at the top of the door opening 14. Alternatively, the door may be a full or partial vertical lift door, wherein the curtain does not roll-up on a roller but instead moves vertically, or at slight angles, above the top of the door opening. A guide structure generally designated by reference numeral 20 is disposed along each side of the opening 14 and receives and guides the side edges of the curtain 12. The bottom of the curtain 12 is provided with a bottom bar generally designated by reference numeral 22.

The guide structure 20 includes an elongated rigid mounting member or bracket 24 in the form of an L-shaped angle having a flange 26 secured to the wall 16 by any suitable fastening structures, such as a bolt, only one of which is schematically illustrated by numeral 28. The mounting bracket 24 also includes an outwardly extending flange 30 perpendicular to the flange 26 which supports a continuous inwardly facing guide or guide member 32 with the guide member opening facing the doorway opening 14. The guide 32 includes an inner flange 34 and an outer flange 36 generally parallel to each other with the flanges connected at one end by portion 38 which is secured to flange 30 by a plurality of fasteners 40 in the form of bolts or the like which extend through openings in the flange 30 and into the portion 38. The flanges 34 and 36 are spaced apart to provide a groove or channel which receives a side edge of the curtain 12.

Figure 2:
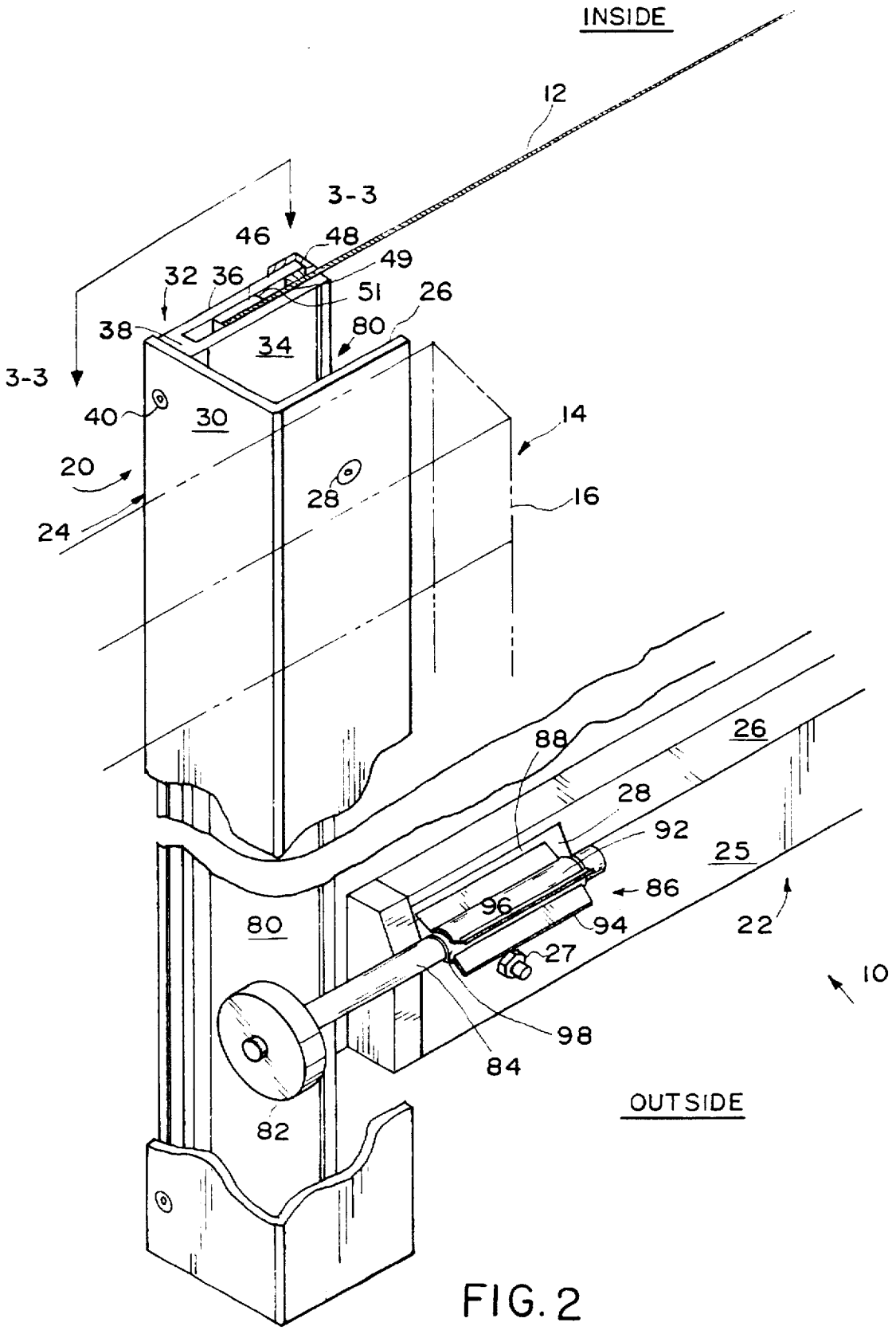
FIG. 2 is a perspective view illustrating a corner of the flexible curtain door and depicting the guide, the curtain, and the mounting bracket assembly along with portions of the bottom bar, retainer, roller and roller shaft arrangements.
Figure 4:
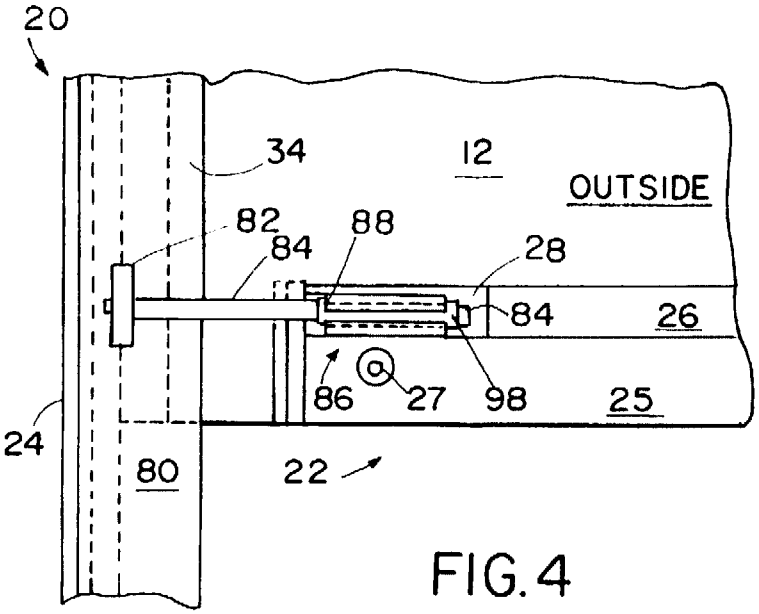
FIG. 4 is a frontal view along line 4–4 of FIG. 3.
Figure 3:
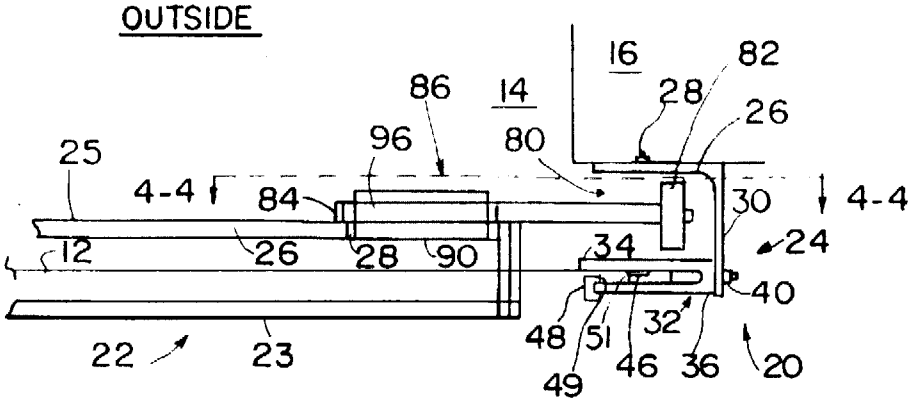
FIG. 3 is a top view along line 3—3 of FIG. 2.

As an alternative mounting arrangement, the flange 26 may extend in the opposite direction from that shown in FIGS. 2 and 3, i.e. in a direction away from the door opening. This may be particularly desirable for walls having wood or masonry jambs, as opposed to steel jambs. In such instances, the guide flange 34 will be in facing relationship to a substantially planar wall surface, which defines the roller guideway to be discussed below.

The side edge of the curtain 12 is provided with a strip or strips 46 bonded to one surface of the curtain side edge. The side edge of the curtain 12 and the strip 46 serves as a wind lock when associated with the guide 32. The strip 46 is preferably not continuous along the entire side edge of the curtain but, rather, is discontinuous along the side edge. The strip 46 may take up approximately 50% of the overall side edge length of the curtain.

The end edge of the flange 36 has an elongated retaining strip or that is snap-mounted thereon with the windbar 48 preferably being constructed of plastic material. A recessed area of the windbar 48 that faces the end edge of the flange 36 provides for a snap mounting engagement with the flange 36. This mounting may be as described in the incorporated U.S. Pat. No. 5,445,209. The wind bar 48 includes a projection 49 that faces a projection 51 on the wind strips 46 to thus retain the side edge portion of the curtain 12 within the guide 32. When the curtain 12 is impacted with an excessive force, such as when a vehicle strikes the curtain, the lateral outward force exerted on the curtain 12 is resisted by the strip 46 engaging the windbar 48 until the lateral force overcomes the resilient snap mounting engagement and the windbar 48 will separate from the flange 36. Thus, the side edge of the curtain can separate from the guide 32 with little or no damage to the curtain 12 or the guide 32. This enables the side edge of the curtain to be reinserted into the guide 32 and the resilient plastic windbar 48 may be reattached to the flange 36 by merely pressing the windbar 48 back into place. Although the drawings illustrate a single windbar and wind strip, a double windbar and windstrip arrangement can be used as is disclosed in U.S. Pat. No. 5,482,104, also incorporated by reference herein.

Under normal wind load and differential pressure conditions, which may include relatively "high" winds to tend to cause a billowing of the curtain 12, the curtain 12 is retained within the guide 32 by the interaction between the wind strips 46 and windbar 48. This may result in frictional contact between the wind strips 46 and windbar 48. This tendency for frictional contact is reduced by the bottom bar arrangement discussed below.

The upper edge of the curtain is secured to the roller drum 18 which is rotatable to enable the curtain 12 to move upwardly and downwardly, i.e. vertically, into and out of the door opening. This movement may take place manually or through use of a motor 70 as is schematically shown in FIG. 1. The roller is supported or affixed to an extension of the guide structure or may be affixed to the wall 16 to provide a rigid upper support for the curtain 12 as it hangs down along the door opening.

As is best shown in FIGS. 2 and 3, the guide 32 and the mounting bracket 24 defines a roller guideway 80 in which a roller 82 is positioned. The roller 82 includes a roller shaft 84 which is journalled to the roller 82 so that the roller 82 may rotate about the shaft 84. The diameter of the roller 82 is slightly less than the transverse space between the flange 34 of the guide 32 and the flange 26 of the mounting bracket 24. Slight differential pressure across the curtain, which normally occurs, will result in the roller bearing against either the guide flange 34 or the flange 26 to enable rolling of the roller 82 in the roller guideway 80. The spacing between the roller 82 and the confines of the guideway 80 is relatively slight to minimize transverse movement in directions into and away from the plane of the door opening 14.

Rigidly and fixedly secured to the bottom edge of the curtain 12 is a rigid bottom bar 22 including bottom bar portions 23 and 25 that are on opposite faces of the curtain 12 and secured to each other through fastening bolts only one of which is shown as numeral 27. These bolts 27 retain the bottom bar portions 23 and 25 affixed to each other and to opposite faces of the flexible curtain 12. The bottom bar portions 23 and 25 are rigid and are not bendable or flexible in a plane substantially perpendicular to the bottom bar portions. The bottom bar 22 is relatively heavy to provide sufficient weight to the curtain so that the curtain hangs generally vertically and in a relatively taut condition. The bottom bar portion 25 which is on the "outside" facing portion of the curtain 12 includes an angular region 26 into which a notch or recess portion 28 is provided and in which is affixed a retainer 86. The retainer is defined by an elongated retaining clip 88. The clip 88 is disposed so that its longitudinal axis is substantially parallel with the bottom edge of the curtain. The length of the retaining clip 88 preferably may be between one and six inches. The retaining clip 88 includes a base web 90 which is fastened to the bottom bar portion 25, within the notch 28, by fastening elements not shown. Such fastening could take place by welding if the bottom bar is of steel or other weldable material. The retaining clip 88 includes a pair of retaining clip arms 92, 94 in facing relationship to each other which are flexible, biased, and made of a material which has a memory so that when pressed apart in opposite directions they spring back into the position as best shown in FIG. 2. Intermediate along each of the clip arms is a profiled portion 96 that is arcuate to accommodate a cylindrical retaining tube 98 also formed of rigid material such as steel. The length of the retaining tube 98 is approximately the length of the retaining clip or may be slightly longer as is shown in FIG. 2. The retaining tube 98 has an inner diameter sized to receive the roller shaft 84. The roller shaft is slightly smaller in diameter than the tube so that there is some limited play between the roller shaft 84 and the retaining tube 98.

The retainer 86 is designed so that when an excessive impact force is provided to the releasable curtain 12, typically imposed upon the lower horizontal bottom bar 22, in either direction, the impact force will result in the bottom bar 22 releasing or breaking away from the roller and roller shaft 82, 84 to enable movement of the bottom bar 22 and curtain 12 in directions into or away from the plane of the door opening depending upon the direction of the impact force. Such force acting on the bottom bar 22 typically takes place when the door is not fully rolled up i.e., is below the top of the door opening and when a toll vehicle passes through the door opening and accidentally hits the bottom part of the curtain 12.

When the bottom bar 22 is struck by a vehicle, or some other excessive force is applied to the bottom bar, the clip arms 92, 94 spring outward with respect to the cylindrical retaining tube 98 and the tube 98 and clip arms 92, 94 separate from each other. The roller and roller shaft 82, 84 will thus freely fall downward and the bottom edge portion of the curtain 12 is released and free to move without being caught up in the guide structure 20, thus reducing damage to the bottom bar and curtain. The bottom bar is intended to release in advance of the releasing or pulling out of the side edges of the curtain 12. That is, the bottom bar is designed to release prior to the breaking away of the windbar 48 from the channel 32 when impacted by the windstrip 46.

Although only a single retainer 86 is depicted, it is understood that each side portion of the bottom bar will include the retainer member and each of the guide structures will include a roller and roller shaft that interconnects with the retainer member in the manner as described above.

It should be noted that the horizontal length of the bottom bar 22 is less than the full horizontal width of the curtain 12. The horizontal length of the bottom bar is such that it lies between the guides 32 that are mounted on either side of the door opening.

It is thus seen that the rigid bottom bar 22 is not only releasably attached to the side guide structures 20 but performs an important function during routine vertical movements of the curtain under normal windload and pressure conditions. By tying in the structural rigidity of the bottom bar 22 to the side guide channel members 20, frictional forces acting between the curtain and the guide flanges 34, 36, and between the windbar 48 and windstrips 46 may be reduced, thus permitting vertical movement to be performed smoothly and without binding. That is, because the roller 82 is captured within the roller guideway 80, relatively high wind forces or pressure differentials on the curtain, albeit "normal", tend to reduce the transverse movement or billowing of the curtain in directions into and away from the plane of the door opening. The rigid roll up drum structure 18 mounted at the top of the doorway also assists in providing structural transverse rigidity at the upper part of the curtain to prevent this transverse billowing tendency of the curtain. By providing structural rigidity tied into the side guide structures 20, the side edge portions of the curtain, at least in the regions of the bottom portion of the curtain and at the top of the curtain where it adjoins with the roll up drum 18 does not billow in inward and outward directions and thus the frictional inter-engagement between the side faces of the curtain and the edge of the guide flanges and between the windbar and windstrip when they engage each other under relatively high wind load conditions, will be reduced.

It is contemplated that other structures intermediate the bottom bar and the roll up drum may be utilized to provide further transverse and lateral stability to the curtain but these arrangements are not preferred and will not be utilized in many usages.

The foregoing is considered as illustrative only of the principles of the invention. Further, since numerous modifications and changes will readily occur to those skilled in the art, it is not desired to limit the invention to the exact construction and operation shown and described and, accordingly, all suitable modifications and equivalents may be resorted to, falling within the scope of the invention as hereinafter claimed.

I claim:

1. A vertically moveable closure door comprising, a flexible curtain having substantially continuous planar faces movable vertically between a closed position in occluding relation to a door opening and an open position out of registry with a door opening, said flexible curtain including top, bottom, and side edges; a rotatable barrel means mountable horizontally adjacent an upper edge of a door opening and connected to said top edge of said flexible curtain for winding the flexible curtain between its open and closed positions; a pair of curtain guides, each curtain guide mountable vertically adjacent opposite sides of a door opening for guiding movement of said flexible curtain between its open and closed positions; a substantially rigid bottom bar attached to at least one of the planar faces of said flexible curtain and along said bottom edge of said flexible curtain and extending horizontally along a substantial width of said flexible curtain, said bottom bar including a pair of retainer members, each retainer member located adjacent opposite ends of said bottom bar, each said retainer member including a release means for capturing and releasing a guide member; a pair of guide members, each guide member including a first portion positionable adjacent said curtain guide and a second portion releasably connected with said release means, wherein said curtain guides, guide members, and rigid bottom bar cooperate to maintain said curtain in a vertically moveable position adjacent a door opening, and wherein said second portion of each said guide member is releasable with respect to said release means to enable said flexible curtain and bottom bar to release and move in directions into and away from the door opening with little damage to the flexible curtain and curtain guide when a sufficient impact force is placed upon said flexible curtain in directions substantially transverse to the door opening.

2. The closure door of claim 1 further comprising a mounting means connected with each said curtain guide for mounting each said curtain guide adjacent a door opening, said mounting means and curtain guide defining a vertical guideway in which said first portion of said guide member is positioned for vertical movement within said guideway.

3. The closure door of claim 2 wherein said first portion of said guide member is a roller.

4. The closure door of claim 3 wherein said second portion of said guide member comprises a roller shaft journalled to said roller, said roller shaft releasably captured by said release means.

5. The closure door of claim 4 wherein said release means includes a tubular member for receiving said roller shaft, said tubular member being releasable from said bottom bar.

6. The closure door of claim 1 wherein said side edges of said flexible curtain are maintained within said curtain guide under normal wind load and pressure conditions and are releasable from said curtain guide when an excessive impact force is placed upon said flexible curtain.

7. The closure door of claim 6 wherein said side edges of said flexible curtain include discontinuous windstrips along said side edges, and wherein said curtain guide includes a releasable windbar to coact with said discontinuous windstrips to restrain said side edges of said curtain from escapement from the curtain guide under normal wind load and pressure conditions, said discontinuous windstrips of said curtain engaging with said windbar when a sufficient impact force is put upon the flexible curtain to cause said windbar to be displaced by separation from said curtain guide thereby enabling said side edges to be released from the curtain guide.

8. The closure door of claim 1 wherein said guide member is releasable with respect to said release means in directions substantially transverse to the door opening.

9. The closure door of claim 1 wherein said bottom bar is free of flexure or bending in directions into and out of the door opening.

10. The closure door of claim 1 wherein said release means is free of laterally inward displacement with respect to said guide member.

11. A vertically movable closure door comprising a flexible curtain movable vertically between a closed position in occluding relation to a door opening and an open position substantially out of registry with the door opening, said curtain including a bottom edge and side edges, said side edges including windstrips along portions of said side edges, a curtain guide mounted adjacent each side of the door opening for guiding movement of said curtain, said curtain guide including a releasable windbar to coact with said windstrips to restrain said side edges of said curtain from escapement from the curtain guide under normal wind load and pressure conditions, said windstrips of said curtain engaging with said windbar when an excessive impact force, such as a vehicle, is put upon the flexible curtain to cause said windbar to be displaced by separation from said curtain guide thereby enabling said side edges of the curtain to be released from said curtain guide, a mounting bracket connected with each said curtain guide to mount said curtain guide adjacent the door opening, said curtain guide and mounting bracket defining a roller guideway, a rigid bottom bar connected to at least one face of said flexible curtain adjacent said bottom edge of said curtain, said bottom bar extending horizontally between each curtain guide, said bottom bar including a retainer member, a roller positioned within said roller guideway for rolling within said guideway during vertical movement of said flexible curtain, said roller including a roller shaft journalled thereto, said roller shaft releasably connected with said retainer member, whereby when an excessive impact force, such as by a vehicle, is put upon said bottom bar, said roller shaft is releasable from said retainer.

12. The closure door of claim 11 wherein said roller shaft is releasable from said retainer prior to said windbar bring displaceable from said curtain guide.

13. The closure door of claim 11 wherein the diameter of said roller is less than the space within said roller guideway in which the roller is positioned.

14. The closure door of claim 11 wherein the positioning of said roller within said roller guideway under normal wind load and pressure conditions limits movement of the curtain in directions into and away from the plane of the door opening so as to reduce frictional contact between said curtain and curtain guide and between said windbar and windstrips during vertical movement of said curtain.

15. The closure door of claim 11 further comprising a rotatable barrel locatable above a door opening with said flexible curtain attached thereto, whereby rotation of said barrel causes the flexible curtain to raise and lower into and out of the door opening.

16. The closure door of claim 11 wherein said windstrips along portions of said side edges are discontinuous along the side edges of said curtain.

17. The closure door of claim 11 wherein said roller shaft is releasable with respect to said retainer in directions substantially transverse to the door opening.

18. The closure door of claim 11 wherein said rigid bottom bar is free of flexure or bending in directions into and out of the door opening.

19. The closure door of claim 11 wherein said retainer is free of laterally inward displacement with respect to said roller shaft.

20. A vertically movable closure door comprising a flexible curtain movable vertically between a closed position in occluding relation to a door opening and an open position substantially out of registry with the door opening, said curtain including a bottom edge and side edges, said side edges including windstrips along portions of said side edges, a curtain guide mounted adjacent each side of the door opening for guiding movement of said curtain, said curtain guide including a releasable windbar to coact with said windstrips to restrain said side edges of said curtain from escapement from the curtain guide under normal wind load and pressure conditions, said windstrips of said curtain engaging with said windbar when an excessive impact force, such as a vehicle, is put upon the flexible curtain to cause said windbar to be displaced by separation from said curtain guide thereby enabling said side edges of the curtain to be released from said curtain guide, a mounting bracket connected with each said curtain guide to mount said curtain guide adjacent the door opening, said curtain guide and mounting bracket defining a roller guideway, a rigid bottom bar connected to at least one face of said flexible curtain adjacent said bottom edge of said curtain, said bottom bar extending horizontally between each curtain guide, said bottom bar including a retaining clip fixedly connected to said bottom bar, said retaining clip releasably capturing a cylindrical retaining tube, a roller positioned within said roller guideway for rolling within said guideway during vertical movement of said flexible curtain, said roller including a roller shaft journalled thereto, said roller shaft insertable within said retaining tube, wherein said retaining clip and retaining tube disconnect relative to each other upon receipt of an excessive impact force upon said bottom bar enabling said roller shaft to be released with respect to said bottom bar.

21. The closure door of claim 20 wherein the disconnection between said retaining clip and retaining tube enables said flexible curtain and bottom bar to be displaced in directions into and away from the plane of the door opening without flexure or bending of said bottom bar about an axis perpendicular to said bottom bar.

22. The closure door of claim 20 wherein said retaining clip includes a pair of retaining clip arms in facing relationship to each other and having a profile to accommodate said cylindrical retaining tube, said retaining clip arms being flexible and biased to secure said retaining tube and being spreadable to release said cylindrical tube upon receipt of an excessive impact force on said bottom bar.

23. A vertically movable closure door including a flexible curtain movable vertically between a closed position in occluding relation to a door opening and an open position substantially out of registry with the door opening, a guide mountable along each side of the door opening for guiding movement of the flexible curtain, each said guide including a guide channel opening toward the door opening, said guide being defined by spaced, generally parallel flanges; coacting means adjacent the side edge of the curtain and on at least one flange of the guide channel to releasably retain the side edge of the curtain within the guide channel, and to release the curtain from the guide channel upon engagement of a sufficient impact force on said curtain, said coacting means including a vertically extending projection fixed adjacent a side edge of the curtain and a vertically extending projection detachably connected to at least one flange of said guide channel with said projections normally facing each other during vertical movement of the curtain and capable of engaging each other under high wind load and pressure conditions, said projection on said at least one flange of the guide channel being releasably secured to said flange to retain the side edge of the curtain within the guide channel during vertical movement and enabling the projection to be displaced by separation from the flange of the guide channel upon an excessive impact force engaging the curtain, thereby enabling the side edge of the curtain to separate from the guide channel; a mounting means connected with each guide to mount said guide adjacent a door opening, said mounting means and guide defining a roller guideway; a rigid bottom bar connected to said flexible curtain at a bottom edge of said flexible curtain, said bottom bar extending horizontally between said guides, said bottom bar including a retainer member; a roller positioned and rollable within said roller guideway; connecting means for releasably interconnecting said roller to said retainer member, wherein the interaction between said roller and roller guideway limits billowing movement of the curtain in inward and outward directions so as to reduce frictional engagement between said projections of said curtain and flange and between the curtain and the guides during vertical movement of the curtain.

24. The closure door of claim 23 further comprising a roller shaft journalled to said roller, said connecting means further comprising a cylindrical retaining rube releasably captured by said retainer member, said retaining tube receiving said roller shaft.

25. The closure door of claim 23 further comprising a rotatable member positioned adjacent the top of the door opening and connected with said flexible curtain, said rotatable member extending horizontally substantially the entire width of said flexible curtain and fixedly mounted so as to provide rigidity to said flexible curtain, wherein said rotatable member and bottom bar cooperate to limit curtain movement in inward and outward directions.

26. A vertically movable closure door comprising a flexible curtain movable vertically between a closed position in occluding relation to a door opening and an open position substantially out of registry with the door opening, said curtain including a bottom edge and side edges, said side edges including windstrips along portions of said side edges, said windstrips being discontinuous along the side edges of said curtain, a curtain guide mountable adjacent each side of the door opening for guiding movement of said curtain, said curtain guide including a releasable windbar to coact with said discontinuous windstrips to restrain said side edges of said curtain from escapement from the curtain guide under normal wind load and pressure conditions, said discontinuous windstrips of said curtain engaging with said windbar when a sufficient impact force is put upon the flexible curtain to cause said windbar to be displaced by separation from said curtain guide thereby enabling said side edges of the curtain to be released from said curtain guide, a substantially rigid bottom bar connected to at least one face of said flexible curtain adjacent said bottom edge of said curtain, said bottom bar extending horizontally between each curtain guide, said bottom bar releasably connected to at least one of said curtain guides to enable said flexible curtain and bottom bar to release and move in directions into and away from the door opening with little damage to the flexible curtain and curtain guide when a sufficient impact force is placed upon said flexible curtain in directions substantially transverse to the door opening.

27. The closure door of claim 26 wherein said substantially rigid bottom bar is free of flexure or bending in directions into and out of the door opening.

28. A vertically movable closure door comprising a flexible curtain having planar faces and movable vertically between a closed position in occluding relation to a door opening and an open position substantially out of registry with the door opening, said curtain including a bottom edge and side edges, each of said side edges including a discontinuous windstrip along said side edge and attached to at least one of said planar faces, a curtain guide mountable adjacent each side of the door opening for guiding movement of said curtain, said curtain guide including a releasable windbar to coact with said discontinuous windstrip to restrain said side edges of said curtain from escapement from the curtain guide under normal wind load and pressure conditions, said discontinuous windstrip of said curtain engaging with said windbar when a sufficient impact force is put upon the flexible curtain to cause said windbar to be displaced by separation from said curtain guide thereby enabling said side edges of the curtain to be released from said curtain guide.

29. The closure door of claim 28 further comprising a substantially rigid bottom bar connected to at least one face of the curtain adjacent said bottom edge of the curtain, said bottom bar extending horizontally between each curtain guide.

* * * * *